US010661921B2

(12) United States Patent
Wehling et al.

(10) Patent No.: US 10,661,921 B2
(45) Date of Patent: May 26, 2020

(54) APPARATUS AND METHOD FOR FILLING AN OPEN CONTAINER

(71) Applicant: HAVER & BOECKER OHG, Oelde (DE)

(72) Inventors: Mark Wehling, Ennigerloh (DE); Volker Schütte, Oelde (DE); Josef Van Bergerem, Ennigerloh (DE)

(73) Assignee: HAVER & BOECKER OHG, Oelde (DE)

( * ) Notice: Subject to any disclaimer, the term of this patent is extended or adjusted under 35 U.S.C. 154(b) by 131 days.

(21) Appl. No.: 15/545,091

(22) PCT Filed: Jan. 19, 2016

(86) PCT No.: PCT/EP2016/050982
§ 371 (c)(1),
(2) Date: Jul. 21, 2017

(87) PCT Pub. No.: WO2016/116427
PCT Pub. Date: Jul. 28, 2016

(65) Prior Publication Data

US 2018/0009552 A1 Jan. 11, 2018

(30) Foreign Application Priority Data

Jan. 20, 2015 (DE) ..... 10 2015 100 779

(51) Int. Cl.
*B65B 1/22* (2006.01)
*B65B 1/26* (2006.01)
*B65B 43/12* (2006.01)

(52) U.S. Cl.
CPC ..... *B65B 1/22* (2013.01); *B65B 1/26* (2013.01); *B65B 43/126* (2013.01)

(58) Field of Classification Search
CPC ..... B65B 1/22; B65B 1/26
(Continued)

(56) References Cited

U.S. PATENT DOCUMENTS 3,858,628 A 1/1975 Bendle
7,877,966 B2 2/2011 Knoke et al.
(Continued)

FOREIGN PATENT DOCUMENTS

DE 864820 C 1/1953
DE 8910081 U1 10/1989
(Continued)

OTHER PUBLICATIONS

Translation of DE 864820, Wacker Geb, Jan. 29, 1959 (Year: 1959).*
(Continued)

*Primary Examiner* — Marina A Tietjen
*Assistant Examiner* — Paul J Gray
(74) *Attorney, Agent, or Firm* — Greer, Burns & Crain, Ltd.

(57) ABSTRACT

An apparatus and method for compacting bulk material in an open container having a compacting device including a poker compactor, the poker compactor having an outer wall and being suitable to be inserted into an open container to cause the outer wall of the poker compactor to contact the bulk material and to degas and compact the bulk material in the open container. The outer wall of the poker compactor is at least partially formed by a gas-permeable, outer suction wall of a suction device and the poker compactor includes a vibration exciter to support degassing the bulk material by way of vibrating motion of the poker compactor generated by the vibration exciter. The vibration exciter is radially surrounded by a tube device and the suction wall surrounds the tube device.

25 Claims, 5 Drawing Sheets

(58) Field of Classification Search
USPC ..... 141/65, 71, 73, 74
See application file for complete search history.

(56) References Cited

U.S. PATENT DOCUMENTS

| | | | | |
|---|---|---|---|---|
| 9,540,123 | B2 | 1/2017 | Vollenkemper | |
| 2014/0305542 | A1* | 10/2014 | Vollenkemper | B65B 39/10 141/10 |

FOREIGN PATENT DOCUMENTS

| | | | |
|---|---|---|---|
| DE | 102005027819 | A1 | 12/2006 |
| EP | 0032481 | A2 | 7/1981 |
| WO | 2007/101836 | A1 | 9/2007 |

OTHER PUBLICATIONS

German Search Report from German Patent Application No. 10 2015 100 779.7, dated Oct. 7, 2015.
International Search Report from International Patent Application No. PCT/EP2016/050982, dated Mar. 21, 2016.
Chinese Search Report for corresponding Chinese Patent Application No. 2016800154308 dated Jan. 19, 2016 (2 pages).

* cited by examiner

APPARATUS AND METHOD FOR FILLING AN OPEN CONTAINER

BACKGROUND

The present invention relates to a packaging system for filling bulk material into open containers, a compacting device for compacting bulk material in an open container and a method for filling and/or compacting bulk material into or in an open container. Although the invention will now be described with reference to filling bulk material into open bags and to compacting bulk material in open bags, the invention is not limited to filling bulk material into open bags and to compacting bulk material in open bags but it may likewise be employed for filling bulk material into other open containers or receptacles such as cartons, buckets, or other open containers and to compact them therein.

The prior art has disclosed a great variety of apparatus and methods for filling bulk material into open containers such as open-mouth bags and compacting during or after the filling process so as to reduce the quantity of bag material required and to allow better and easier stackability of filled and closed bags.

When filling bulk material into open bags a fluid such as air may be added to increase flowability of the bulk material. In the case of very lightweight materials a considerable portion of air tends to be present in the bulk material before filling starts. In order to reduce the required container size and also the transport costs, the open containers are actively or passively deaerated during or after filling to reduce the air content in the bulk material.

For better compacting the filled bulk material, bottom vibrators have been disclosed which act upon the container bottom and considerably contribute to deaerating bagged bulk material by way of the introduced vibrations. For some bulk materials such compacting is not sufficient or compacting takes too long so that the filling rate efficiency decreases.

DE 10 2005 037 916 A1 has disclosed a machine for forming, filling and closing bags which manufactures bags from a plastic tube and in a filling station a downspout of a batching element is inserted into the open-top end of the bag. The downspout is provided with a screw conveyor for transporting the filled material to thus fill the bag. The downspout is surrounded by a closing tube. During the dosing process a separate conveying system lowers the bag during filling in such a way that the product discharge opening will at all times be positioned beneath the filled level. If required, suction combined with the dosing process is possible through the filter integrated in the closing tube, wherein air suction results in compacted bulk material to a certain degree. This effect of product compacting may be enhanced further by additionally employing vibration generators or rappers. Such rapping on the closing tube from outside will be done on top immediately beneath the hopper. The vibrations are transmitted through the closing tube and the downspout into the filling material. In the alternative a vibrator may be disposed at the bag bottom support unit and act onto the bag bottom from beneath. The known machine shows the drawback that conveying the product through a conveyor screw in the downspout requires a relatively large diameter of the batching element and can only provide rather low filling rates. Lowering the bag during the filling process also takes time and furthermore involves considerable complexity of apparatus. There is also the considerable disadvantage that the metering tube requires a large batching element diameter so as to only allow filling bags showing a large enough diameter at the top end. Moreover relatively little energy and just a small vibration amplitude can be introduced into the filled product so that efficiency is limited.

Therefore, using vacuum lances has been disclosed which enter into an open bag from above during the filling process, inducing air through an applied vacuum by way of the outer lance surface and carrying off the air in the interior. These vacuum lances increase the filling rate in particular in the case of lightweight bulk materials, even though bulk material tends to build up caking on the outer vacuum lance surface during the filling process so as to considerably reduce the efficiency of the vacuum lance since outer regions are no longer reached. Moreover the filter may become clogged over time.

An efficient method has been found to be the use of a poker vibrator which is also inserted into the open bag from above through the filling spout and which shows a rotatably supported imbalance in the interior of the poker vibrator serving as a vibration exciter and causing vibrating movement of the poker vibrator during rotation, so that the bulk material surrounding the poker vibrator is deaerated. In the case of particularly lightweight bulk materials it may be less than efficient to use a poker vibrator, perhaps because the poker vibrator tends to rather be stirring the bulk material around if the material is that lightweight, instead of achieving efficient deaeration.

DE 10 2011 119 451 A1 has disclosed a packaging machine for filling bags which allows high filling rates combined with high weight accuracy. The known packaging machine provides for using filling turbines for conveying the filling product. Two separate compacting devices are assigned to each of the filling spouts. A compacting device is configured as a bottom vibrator and disposed beneath the bag bottom. During the filling process a vacuum lance serving as another compacting device may enter the bag interior from above through the filling spout, compacting the filled product. It is noted that it is possible to optionally or product-related or successively insert a poker vibrator serving as a compacting device and a vacuum lance serving as a compacting device into the filling spout from above. Although the known packaging machine operates satisfactorily, it shows high complexity due to the high number of different compacting devices and pertaining adjustment devices. For bagging particularly lightweight materials, devices and methods have been disclosed where external pressure is applied on the bags while bulk material is filled into flexible bags to generate high internal pressure so as to achieve a considerably improved deaeration performance due to the high pressure difference to the ambience. This method shows the drawback, however, that the filling mouth requires pressure-tight sealing and that process control requires either the use of a pressure sensor or meticulous execution to prevent the flexible bags from bursting which would contaminate the ambience.

It is therefore the object of the present invention to provide an apparatus and a method and a packaging system which allow efficient filling and deaerating also of lightweight bulk materials while involving relatively little complexity.

SUMMARY

An inventive compacting device comprises a poker compactor for compacting bulk material in an open container. The poker compactor has an outer wall and is suitable to be inserted into an open container with bulk material in particular during a filling process to cause the outer poker compactor wall to contact the bulk material and to degas and compact the bulk material in the open container. The outer poker compactor wall is at least partially formed by a gas-permeable outer suction wall of a suction device and the poker compactor comprises a vibration generator and in particular a rotatably accommodated imbalance device so as to reduce any caking of the bulk material at the suction wall and to support degassing of the bulk material by way of a vibrating motion of the poker compactor generated by the vibration generator or the imbalance device. In particular the vibration exciter is radially enclosed in a tube device and the suction wall surrounds at least sections of the tube device.

The compacting device according to the invention has many advantages. The inventive compacting device allows efficient filling of bulk material into open containers and efficiently degassing the bulk material. The fact that the poker compactor is provided with both a suction device and a vibration generator, contributes to considerably reduce caking and clogging of the suction wall of the suction device and in many cases it is nearly entirely prevented. Any bulk material particles deposited at the suction wall are immediately removed by way of the vibrating motion of the vibration generator. The vibrating motion of the poker compactor results in local displacement of the bulk material present such that the gas contained in the bulk material such as in particular air accumulates in the forming cavities and can be effectively carried off through the suction device and through the poker compactor.

Surprisingly it has been found that the vibrating motion of the poker compactor can enormously increase the efficiency of the suction device. The reason therefore is believed to be that the suction wall is prevented from clogging and any air content in the volume can be efficiently sucked off.

The vibrations of the vibration generator or the rotation of the imbalance device causes a compacting motion of the poker compactor. In all the specific embodiments it is preferred for the vibration generator to generate a circumferential vibration and in particular to rotate for generating vibration.

The poker compactor is preferably substantially rotationally symmetrical in configuration and it may for example show a substantially cylindrical shape. In all the configurations it is preferred for the vibration generator to comprise, or in particular to be configured as, one or at least one imbalance device.

In a preferred specific embodiment the vibration generator and/or the imbalance device is/are radially surrounded by a tube device. This allows to reliably protect the vibration generator and/or the imbalance device from contact with the filled or compacted bulk material. It is not required for the imbalance device to be stirring in the compacted bulk material itself but the rotating imbalance device is accommodated, protected by the tube device. The tube device in particular shows reduced gas permeability over the suction wall and is in particular configured substantially air-impermeable.

It is preferred for the suction wall to surround the tube device at least in sections. The suction device in particular surrounds the vibration generator or the imbalance device in the radial direction.

In preferred specific embodiments the suction wall at least partially consists of an air-permeable filter device. The filter device preferably comprises at least one fine-mesh filter layer which is protected and/or supported by at least one coarse-mesh filter layer. It is possible for the filter device to comprise a stack of multiple filter layers at least partially showing different degrees of mesh fineness. A protection layer showing coarser mesh is preferably disposed radially outwardly than radially farther inwardly. It is possible to provide multiple filter layers having different degrees of mesh fineness. Particularly preferably a fine-mesh or the finest-mesh filter layer is protected outwardly by a coarse-mesh filter layer provided with thicker wires. The filter device is supported radially inwardly by a suitably stable support layer or the like.

In all the configurations the mesh or individual mesh apertures of individual filter layers may show a quadratic, rectangular, round, oval, or other cross-sectional shape. A dimensional ratio of length to width of each mesh aperture is in particular smaller than 10:1 and in particular smaller than 5:1. Mesh dimensions configured round or quadratic are preferably used.

Using sintered cloth for a filter layer is also preferred. Expanded metals, braids, knitted fabric and other known filter layers may be used as well.

It is particularly preferred to provide the tube device with exchangeable filter devices. The filter device is in particular protected by the tube device. Then the tube device for one serves the purpose of accommodating the imbalance device or the vibration exciter inside the tube device so as to be shielded from the bulk material and for another, the tube device limits the suction device radially inwardly.

It is possible and preferred for the suction device to be indirectly or directly axially downstream of the tube device and/or the vibration generator and/or the imbalance device. This means that the suction device may be disposed at least partially axially adjacent to the tube device. Particularly preferably the suction device is provided radially surrounding the tube device. Or else it is possible for the suction device to be partially or entirely axially adjacent to the tube device and/or the vibration generator and/or the imbalance device.

In advantageous configurations the poker compactor is configured elongated. The ratio of the length of the poker compactor to the diameter of the poker compactor is preferably larger than 3 and in particular larger than 4. Particularly preferably the poker compactor shows an outer diameter and in particular a maximum outer diameter of less than 65 mm. Or else, outer diameters of the poker compactor of 45 mm or 50 mm or 60 mm are possible. Small diameters of 60 mm or less place a huge challenge on the construction since, other than the vibration generator or the imbalance device, the suction device must also be disposed at the poker compactor. Then if the suction device is also disposed radially around the vibration generator or the imbalance device, the radial space available for generating vibration is small.

The vibration generator or the imbalance device is preferably rotatably driven by means of a drive shaft extending into the poker compactor from a front face. The front face is located opposite the bottom face of the poker compactor. The drive shaft is preferably supported for rotation relative to the poker compactor. The drive shaft may be configured as one piece or multi-part. The drive shaft is preferably driven by a motor.

In all the configurations the vibration exciter is disposed in the interior of the poker compactor. Although the drive motor may be provided external it may be disposed in the interior. The vibration generator may also comprise, or be configured as, a sprung vibration system. The vibration excitation may be electromagnetically stimulated in all the configurations.

By way of generating vibrations any filter clogging is reliably prevented or markedly delayed.

In all the configurations it is preferred for at least one bearing for supporting the drive shaft to be located in an axial end region of the tube device. Preferably at least one bearing each for supporting the drive shaft is received in both axial end regions of the tube device. Additional center supports are likewise possible. This achieves a high degree of stability which is advantageous with the loads occurring.

In preferred specific embodiments the poker compactor front face comprises a connecting piece with a passage for the drive shaft and/or a closed bottom cover in the bottom face. It is also possible to provide the bottom face with a suction wall for extracting gas and in particular air out of the bulk material, only and/or including through the bottom face of the poker compactor.

In all the configurations the suction device preferably comprises a vacuum chamber that is in particular substantially formed by a radial intermediate space between the tube device and the filter device. In these configurations the suction device surrounds the tube device at least in part.

In another preferred specific embodiment of the invention the vacuum chamber is indirectly or directly connected with at least one vacuum connection through at least one air duct. The vacuum connection may in turn be indirectly or directly connected with a switched vacuum valve. The vacuum connections are in particular disposed on the front face of the poker compactor.

Advantageously the air duct or at least one air duct or in particular all of the air ducts extend(s) at least partially radially outside of the bearings. In this way the bearings for supporting the drive shaft are largely protected from the influence of dust due to the bulk material.

In advantageous configurations the air duct at least partially extends through the tube device and/or is at least partially formed by the tube device. A part section of the air duct may for example be limited by a groove in the tube device.

The connecting piece is in particular configured at least in two parts and it may be provided multi-part. Then the connecting piece consists of two or more connecting parts which can particularly preferably be connected to one another so that the connecting parts can be (readily) separated from one another. As a rule a first connecting part then remains at the machine during exchange or servicing of the compacting device while the second connecting part with the poker compactor is removed to exchange, check, or clean parts or the like. The first (and preferably upper) connecting part may be provided with fixedly attached air and/or vacuum connections. Demounting the poker compactor is thus less complex since the second (and preferably lower) connecting part can be removed without requiring separately detaching and—later, again separately—reattaching each of the hose connections. Since the compacting device is height-adjusted on a regular basis, the vacuum hoses must be adapted for flexible height adjustment or their height is likewise adjusted. The vacuum hoses are as a rule installed in a specific way and in particular in a spiral around the flexible connecting hose for the drive shaft, to prevent rubbing against the filling spout during lifting and lowering. The first and second connecting parts are preferably connected to one another by means of suitable fasteners (e.g. screws or the like). At least one seal or two or more seals may be disposed between the connecting parts to provide for sufficiently dust- and gas-tight connections.

Preferably at least one flexible connecting hose is fastened to the connecting piece. It is possible and preferred to dispose at least one vacuum line in the flexible connecting hose. The vacuum line may be configured in the flexible connecting hose or may be guided or shaped at the flexible connecting hose. It is for example possible for the flexible connecting hose to comprise an outer wall configured at least partially in a thickness so that a vacuum line is configured in the outer wall. Or else it is possible to dispose or guide separate vacuum lines inside the flexible connecting hose.

A flexible connecting hose extending away from the front face of the poker compactor for example offers the advantage that no bulk material or just a minor quantity of bulk material accumulates on the front face of the poker compactor which might drop down and contaminate the ambience after removal from the poker compactor.

In preferred embodiments the drive shaft interior comprises at least one vacuum duct extending in a longitudinal direction of the drive shaft. The vacuum duct in the interior of the drive shaft serves in particular to feed vacuum to the suction device. It is possible to provide vacuum in the drive shaft interior through the vacuum duct only. It is also possible for a vacuum duct in the drive shaft interior and a vacuum line external of the drive shaft to serve for vacuum supply.

A vacuum duct, if provided in the drive shaft interior, is preferably provided with at least one transverse duct. Then the vacuum duct is preferably in flow connection with a connecting duct of the poker compactor via the transverse duct. This connecting duct may be configured as an annular space extending in a circle around the drive shaft in the transverse duct region. The transverse duct may for example be a bore extending from the outer surface of the drive shaft up to the vacuum duct in the interior of the connecting axle. This establishes a flow connection from the vacuum duct in the interior of the drive shaft up to the outside surface of the drive shaft. The transverse duct may be oriented perpendicular, or at an angle, to the longitudinal axis of the drive shaft.

Preferably the connecting duct connects the vacuum duct with the air duct at least temporarily. When the connecting duct does not extend in a complete circle around the drive shaft then the connecting duct is not supplied with a vacuum at all times during drive shaft rotation but only as the transverse duct establishes a flow connection with the connecting duct. The air volumes in the interior of the drive shaft and at the suction device are preferably dimensioned such that a periodically established vacuum connection is sufficient for the function. A vacuum generator serves to supply the vacuum required.

In preferred configurations the connecting duct is sealed relative to the drive shaft by way of at least one seal at least on one axial side. The connecting duct is in particular sealed relative to the drive shaft on both axial sides by way of at least one seal. This reliably prevents dust from floating for example in the direction of the drive shaft bearings.

A packaging system according to the invention comprises at least one open container intended for filling with a bulk material and at least one packaging machine having at least one filling spout for filling open containers with bulk material. In particular an open container can be appended to the filling spout by way of movement and in particular upwardly movement relative to the filling spout. Or else the open container can be placed beneath the filling spout without appending or connecting the open container to or with the filling spout. The packaging machine comprises at least one compacting device including a poker compactor which can in particular be inserted into the open container from above. The poker compactor comprises an outer wall and is suitable to be inserted into an open container to cause the outer wall to contact the bulk material and to degas and compact the bulk material in the open container. This may be done in particular during the filling process with bulk material. The outer wall of the poker compactor is at least partially formed by a gas-permeable outer suction wall of a suction device and the poker compactor comprises a vibration generator and/or a rotatably accommodated imbalance device to support degassing the bulk material by way of the vibrating motion of the poker compactor generated by the vibration generator or the imbalance device. In particular is any caking of the bulk material on the suction wall decreased. Instead of, or in addition to, an imbalance device some other vibration generator may be provided in the interior of the poker compactor. The vibration exciter is in particular radially surrounded by a tube device and the suction wall surrounds the tube device preferably in sections.

The packaging system according to the invention also has many advantages since it allows efficiently filling and deaering filled bulk material.

A filling spout may have a pressure sensor and/or a filling level sensor assigned to it to control the filling process in dependence on sensor data.

The packaging system or the packaging machine of the packaging system may in particular comprise a compacting device as it was described above.

Preferably a filling element is assigned to each filling spout or at least to one of the filling spouts of the packaging system. The filling element employed is in particular a filling turbine. Conveying is e.g. possible by way of gravity feed or by employing an air filling element where controlled air supply fluidizes the bulk material and conveys it gravity-assisted. The filling element is preferably selected in dependence on the intended filled product.

The method according to the invention serves to fill an open container with at least one bulk material during a filling process and/or to degas bulk material in an open container which was previously, or is being, filled into the open container. For degassing, a poker compactor of a compacting device is inserted into the open container to degas and compact the bulk material in the open container. A vibration exciter or a vibration generator which is in particular radially surrounded by a tube device of (in particular at or in) the poker compactor is caused to vibrate or an imbalance device at the poker compactor is caused to rotate and a suction device sucks gas out of the bulk material at the poker compactor through a gas-permeable, outer suction wall surrounding the tube device as a part of the outer wall in particular at least in sections so as to support degassing the bulk material by way of a vibrating motion of the pivot poker compactor generated by the vibration generator in the interior of the poker compactor. In particular is any caking of the bulk material on the suction wall decreased. The imbalance device may in particular serve as the vibration exciter.

The method according to the invention also has many advantages since it enables efficient filling and/or compacting bulk material into or in an open container. Caking of the bulk material is reliably prevented by way of causing vibrating motion of the poker compactor.

Preferably the poker compactor is inserted into the open container as the filling process begins. It is possible to insert the poker compactor prior to or after beginning to fill bulk material into the open container. The poker compactor may operate during the filling process so that particularly efficient filling is achieved. The poker compactor is preferably height-adjustable. Particularly preferably the poker compactor can be inserted into the container through the filling spout. Advantageously the poker compactor is lowered into the container and in particular into an open bag from above through the filling spout as the filling process begins or is in an initial stage. At the end of the filling process the poker compactor is returned upwardly to the top.

In preferred configurations the length of the poker compactor is shorter than the length of the container. Particularly preferably the ratio of the length of the container to the length of the poker compactor is larger than 1.5 and preferably larger than 2.0.

In all the specific embodiments and configurations of the invention the suction device preferably does not suck gas out of the bulk material until the filling level of the bulk material in the container covers the suction wall at least substantially entirely and in particular entirely. The advantage is that substantially no ambient air is aspirated. Suction is not activated until the fill level is high enough. In particular is the imbalance device at the poker compactor caused to rotate simultaneously at least in sections and gas and in particular air is sucked out of the bulk material at the poker compactor. Or else it is possible to cause rotation of the imbalance device only at the poker compactor at least in sections or to suck gas out of the bulk material only at the poker compactor.

In advantageous specific embodiments the poker compactor is inactive at least in sections.

Preferably a gas impulse is applied to the suction device at certain points in time, at regular or irregular intervals. Air can blow out to the outside from the interior of the suction device. Or else it is possible to only switch off the vacuum so that substantially no air exits to the outside from the suction device. A gas impulse or switching off the vacuum can enhance detachment of filter cake that still builds up on the filter device of the suction device. This gas impulse may for example be emitted at regular intervals. This in particular allows to remove single, fine particles from the filter fabric of the filter device so it maintains its full deaeration performance.

On the whole the invention provides a compacting device and a packaging system equipped therewith and a method with which to allow more efficient filling of bulk material into open containers and in particular open bags. The vibrating motion of the imbalance device achieves better compacting results in particular in the case of lightweight product of less than 0.5 $kg/dm^3$ and in the case of particularly lightweight product of less than 0.3 $kg/dm^3$. The vibration delays, or entirely eliminates, any building up of a filter cake on the filter device. Thus the penetration depth of the vacuum increases so as to increase the aspiration effects.

In all the configurations of the invention it is preferred for the vibration generator and in particular the imbalance device to compact the bulk material in a continuous rotation. The vibration enlarges the action circle. The circulating vibrating motion in particular causes a wobbling motion of the poker compactor. Particularly preferably the poker compactor does not rotate about its longitudinal axis.

The invention offers the further advantage that for a first sort of processed product the action radius of the poker compactor is considerably increased by aspiration. In this product sort or this product type the applied vacuum provides for an adhering bulk material whereby the effective diameter of the poker compactor is enlarged. Although the outer diameter of the poker compactor is relatively small, the applied vacuum thus cares for a larger action diameter of the poker compactor in many fine products. This boosts degassing by the poker compactor and increases efficiency. In predetermined or sensor-captured intervals the suction device may be ventilated with atmosphere or excess pressure. This causes the bulk material cake of this first product type to break up under the influence of the vibrations of the vibration generator. Then new product gets to the filter device and is efficiently compacted.

In a second sort or a second product type of bulk material intended for processing, aspiration results in a more brittle filter cake of adhering bulk material which keeps breaking up so that again, the action range of the poker compactor enlarges.

BRIEF DESCRIPTION OF THE DRAWINGS

Further advantages and features of the present invention can be taken from the exemplary embodiments which will be described below with reference to the enclosed figures.

These show in.

DETAILED DESCRIPTION

Figure 1:
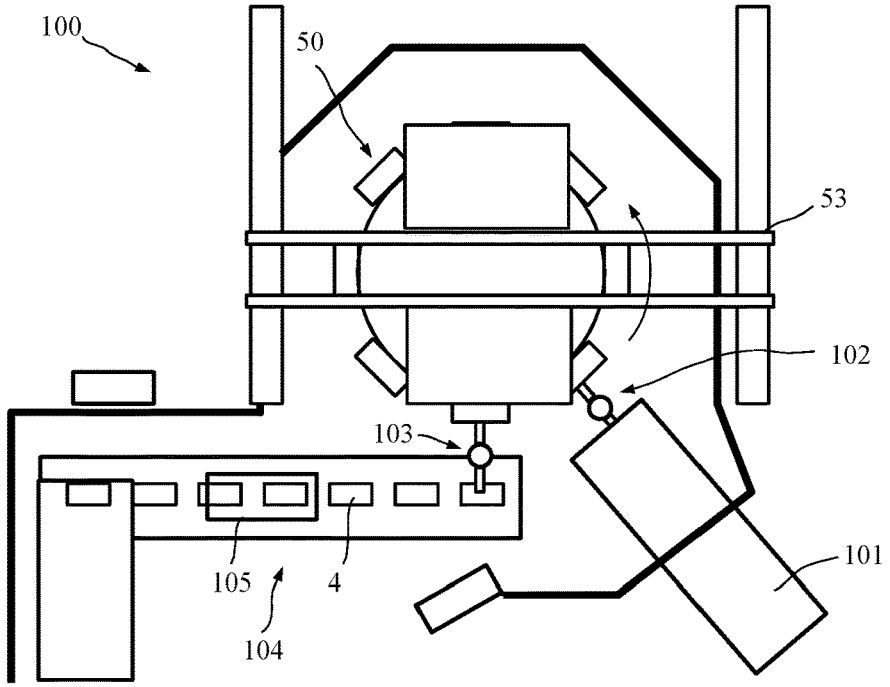
FIG. 1 a schematic top view of a packaging system according to the invention.

FIG. 1 illustrates a simplistic top view of a packaging system 100 according to the invention. The packaging system comprises a packaging machine 50 with which to fill bulk material into open containers, presently into open-mouth bags. The packaging machine 50 is rotary in configuration and comprises a number of filling spouts 51 distributed over its circumference (see FIG. 2). This illustrated packaging machine 50 is provided for approximately two to sixteen filling spouts 51. A packaging system 100 according to the invention may also be configured as a stationary, single-spout packaging machine.

The rotary packaging machine 50 is operated rotating continuously so that the filling spouts 51 rotate at substantially constant speed around a central axis. The rotation speed is in particular dependent on the intended filled product and its compacting ratio. The intended filled bulk material is filled into a silo 52 of the packaging machine 50 through an inlet hopper. From there the bulk material is conveyed by gravity feed into the dispensing silos 58 of the respective filling spout 51.

For feeding the open containers 4 intended for filling a container feeder 101 is provided in which the containers intended for filling may optionally be manufactured, for example from a tubular sheet. A transfer device 102 hands the containers intended for filling to the packaging machine 50 where they are appended after or during transfer to the filling spout 51 substantially dustproof to avoid as far as possible contamination of the ambience during the filling process.

The packaging machine 50 in the embodiment according to FIG. 1 rotates counterclockwise. The packaging machine 50 is appended to a carrier 53 and it may be externally protected by means of the shown protective fence to exclude accidents.

When the filled containers 4 are sufficiently filled as they reach the discharge device 103 and the bulk material is sufficiently compacted, the discharge device 103 takes off the open containers 4 and hands them to the processing device 104 where subsequent compacting may be performed as required and the open containers are regularly closed. To this end a closing device 105 is provided in which open bags representing open containers 4 are closed by a closing seam at the filling end. Weight checking and/or optical checking of the filled container 4 may be provided for at the processing device 104. Finally the filled containers 4 are conveyed off.

Figure 2:
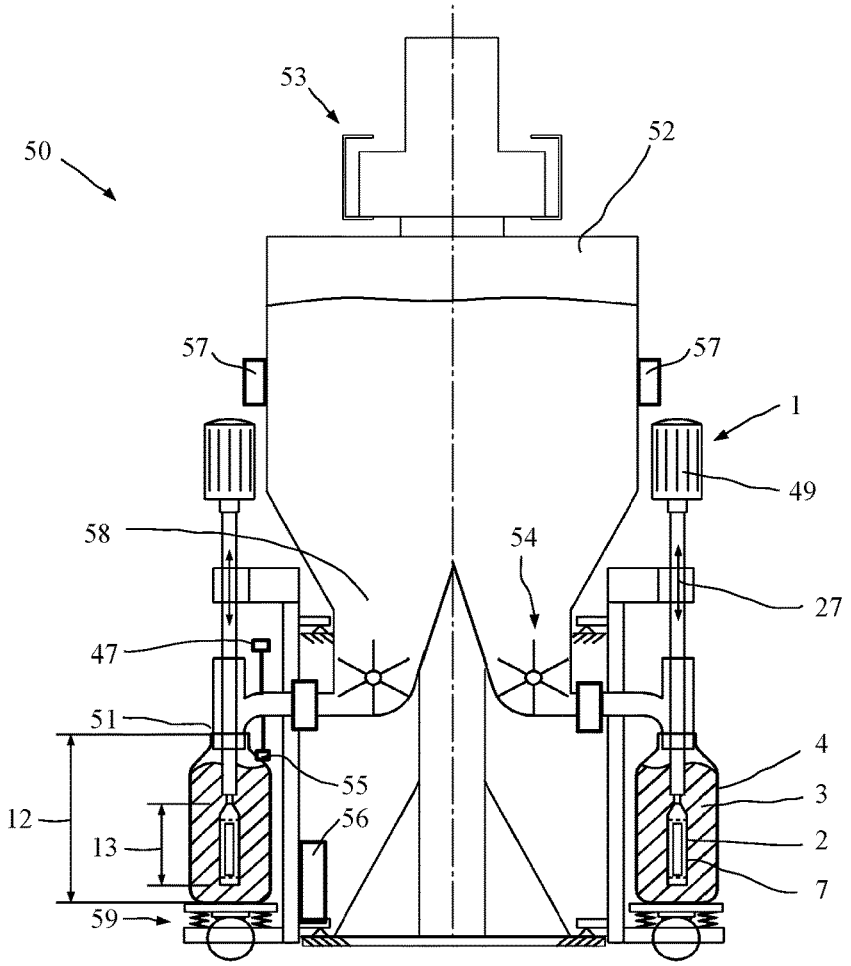
FIG. 2 a side view of the packaging machine of the packaging system according to FIG. 1.

FIG. 2 shows a simplistic cross-section of the packaging machine 50 of the packaging system 100 according to FIG. 1. The packaging machine 50 rotates about the central axis and is appended to the carrier 53. In the silo 52 the curved line shows the filling level of the bulk material in the silo 52. The bulk material may be pre-deaerated by way of intermediate storage in the silo 52 so that the bulk material actually entering the container will as a rule show identical or at any rate similar properties.

Owing to its weight the bulk material enters the dispensing silos 58 assigned to each of the spouts. The filling box at the bottom of the dispensing silo 58 has filling elements 54 which are preferably fill turbines and serve for defined transport of the bulk material through the filling spout 51 into the open containers 4.

In all the configurations the bulk material intended for filling and/or the filled bulk material is weighed. Weighing may be provided by the net method wherein first the intended quantity of bulk material is filled into a pre-container where it is weighed. After the intended filled weight is reached the quantity of bulk material in the pre-container is filled into the open container 4. Filling by way of the gross method is also preferred where the container intended for filling is weighed during the filling process to ensure precisely batched filling. This gross weight method is illustrated in FIG. 2 where the filling spout is weighed during filling together with the attached components and the container 4. The known weight of the filling spout and of the other components is subtracted from the weight determined by the scales 56 to thus calculate the quantity of the filled bulk material 3.

Control devices 57 are employed for controlling which may for example be assigned to each single filling spout 51. It is also possible to employ one control device for multiple filling spouts.

The packaging machine 50 furthermore comprises one compacting device 1 for each of the filling spouts 51. The compacting devices 1 comprise a drive motor 49 and a poker compactor 2 each. After a container 4 has been appended to the filling spout 51 the poker compactor 2 is inserted from the top through the filling spout 51 into the container 4 for compacting the filled-in bulk material. As the filling process is finished and prior to discharging a container 4 the poker compactor 2 is pulled back upwardly out of the container 4 at least up into the filling spout 51 to enable easy discharge of the filled container 4.

The compacting device 1 is employed during the filling process and comprises in the poker compactor an imbalance device 8 illustrated in detail in the following figures and a suction device 6 for compacting the bulk material 3 in the container 4. As FIG. 2 shows, the length 13 of the poker compactor 2 is less than about half the length of the container 4. The poker compactor 2 is lowered at the beginning of the filling process approximately entirely down to the bottom of the container. As the suction wall 7 (between the horizontal broken lines) is substantially entirely covered in bulk material 3, aspiration is activated and air is sucked out of the bulk material. In the course of the filling process the poker compactor 2 is continuously or stepwise moved along upwardly so that the product may be optimally compacted right after filling. There is no need to wait until the entire container 4 or the entire open-mouth bag is filled before starting degassing by means of a vacuum. This allows to save valuable time. A bottom vibrator 59 may be provided from beneath which applies vibrations on the bottom of the container 4. Controlling the filling process may involve a fill level sensor 55 which captures the filling level of the bulk material 3 in the container 4.

Figure 3:
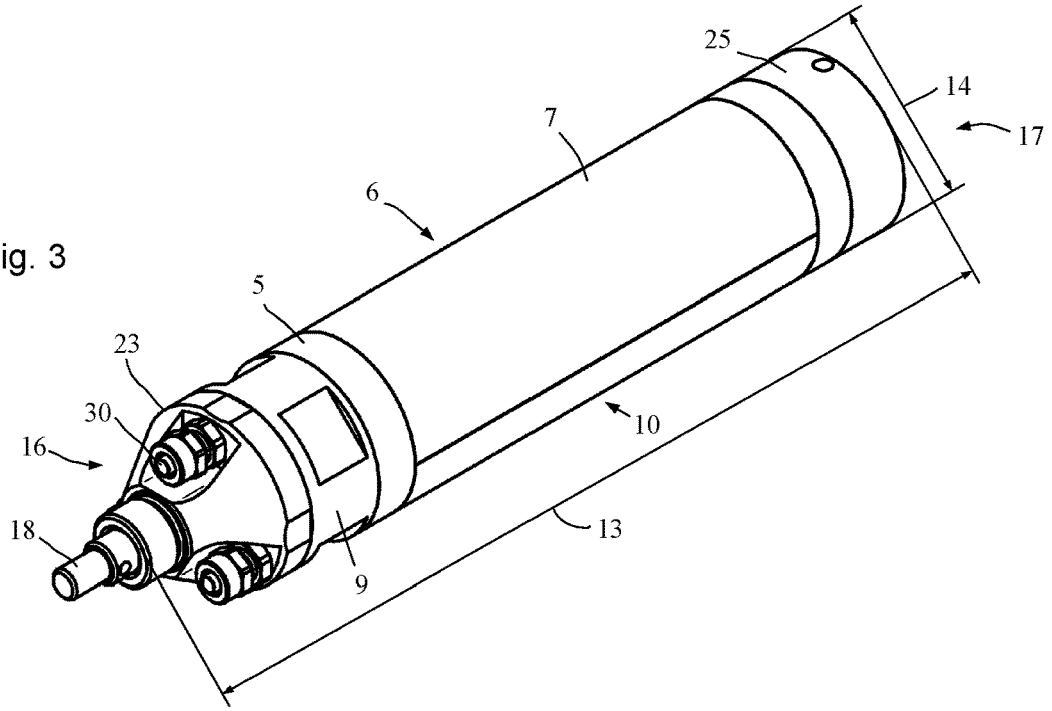
FIG. 3 a perspective illustration of the poker compactor of the compacting device from the packaging machine according to FIG. 2.

FIG. 3 shows a schematic, perspective illustration of the poker compactor 2 of the compacting device 1. The poker compactor 2 shows a front face 16 and a bottom face 17. The drive shaft 18 protrudes out of the poker compactor 2 at the front face 16. The drive shaft 18 is rotatably supported in the interior of the poker compactor 2. The front face 16 is provided with a connecting piece 23 to which multiple vacuum connections 30 etc. are attached to supply the suction device 6 of the poker compactor 2 with the required vacuum. The suction device 6 is retained by the tube device 9 and comprises a filter device 10 which forms an air-permeable suction wall 7 that is part of the outer wall 5 of the poker compactor 2. The interior space of the poker compactor 2 is closed by a bottom cover 25 on the bottom face 17. Although this bottom cover 25 is airtight it may be provided with a filter device to thus aspirate air out of the container 4 at the bottom face 17 of the poker compactor 2.

On the whole the poker compactor 2 has a length 13 which is considerably larger than a typical and in particular maximum diameter 14 of the poker compactor 2. The ratio of the length 13 to the diameter 14 is preferably larger than 3 and in particular larger than 3.5 or 4.

The outer diameter of the poker compactor 2 depends on the intended application. For filling typical open-mouth bags the outer diameter 14 must be small enough to allow inserting the poker compactor 2 from above through the filling spout into the container 4 intended for filling. Therefore the outer diameter 14 is preferably selected to be smaller than 75 mm and in particular smaller than 60 mm. In advantageous configurations an outer diameter of 60 mm was chosen. The length 13 may be 200 mm, 230 mm or more.

Figure 4:
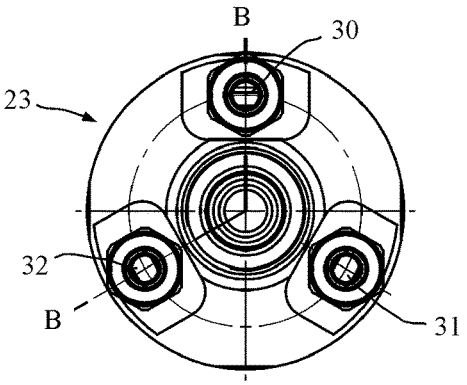
FIG. 4 a front view of the poker compactor according to FIG. 3.

FIG. 4 shows a schematic front view of the poker compactor 2 according to FIG. 3, clearly revealing the three vacuum connections 30, 31 and 32 at the front face 16 at the connecting piece 23.

Figure 5:
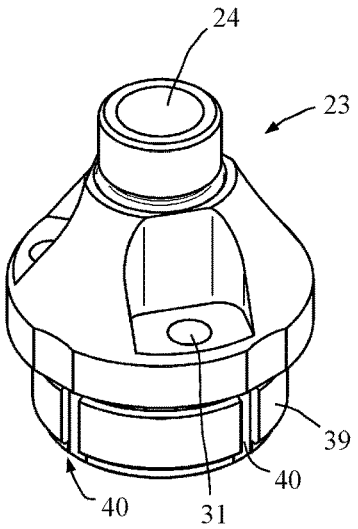
FIG. 5 a perspective illustration of the connecting piece of the poker compactor according to FIG. 3.

FIG. 5 illustrates a perspective illustration of the connecting piece 23 with the passage 24 for feeding through the drive shaft 18 visible. The vacuum connections are illustrated without hose connections.

At the end of the connecting piece 23 opposite the front face 16 the connecting piece 23 has an external thread 39 for the connecting piece 23 to screw into the tube device 9. To ensure vacuum supply in the interior of the poker compactor 2 the outside of the thread 39 is provided with a number of circumferentially distributed, axial grooves 40 through which the vacuum can be forwarded from the connection points 30, 31 and 32.

Figure 6:
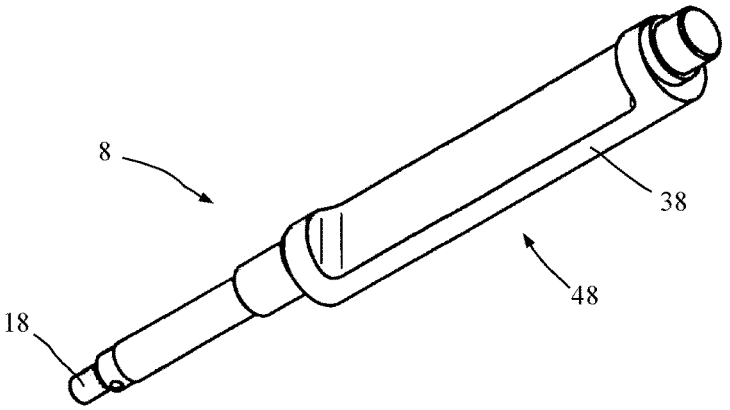
FIG. 6 a schematic perspective view of the drive shaft of the poker compactor according to FIG. 3.

FIG. 6 shows the drive shaft 18 in a perspective illustration wherein the imbalance weight 38 of the imbalance device 8 is recognizable. The imbalance device 8 serves as a vibration exciter 48 and provides for vibration excitation generated in the interior of the poker compactor 2 so as to achieve a particularly effective action of the poker compactor 2 and thus of the compacting device 1. The vibrating motions of the poker compactor 2 are thus exactly defined and are hardly dependent on external circumstances. If the imbalance device were generated external of the poker compactor 2 for example at the top end of the compacting device 1 at the drive motor 49, then the vibration amplitude of the poker compactor 2 would very much depend on external circumstances. In the case of very lightweight bulk material this might result in undesired, large vibrational swings since the distance between the drive motor 49 and the poker compactor 2 results in just minor damping of the vibrating motion in the case of a lightweight bulk material.

With the present invention the vibrating motion is generated locally where it is required, i.e. inside the poker compactor, so that the vibrating motion depends considerably less on external circumstances and is thus better defined. Selecting the imbalancing mass allows to modify the amplitude, selecting the drive number, the frequency. This allows an adaptation of the poker compactor optimized for the intended filled product.

The vibrations are excited within the poker compactor and in this case, inside the suction device which radially surrounds the imbalance device 8.

Figure 7:
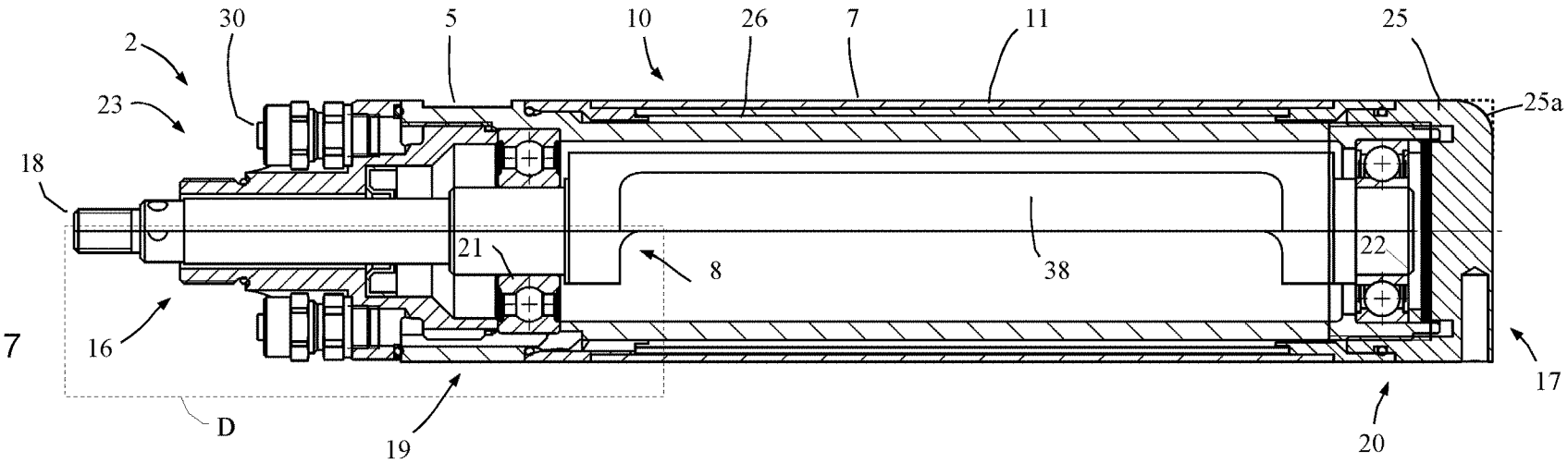
FIG. 7 a schematic cross-section of the poker compactor according to FIG. 3.

FIG. 7 shows a schematic cross-section of the poker compactor 2 of the compacting device 1. The body of the poker compactor 2 is formed by the connecting piece 23, the tube device 9, and the bottom cover 25. The bottom cover may—as is shown in the illustration on the right—show a (nearly) rectangular cross-section. Preferably the bottom cover shows a rounded end region 25*a*. This allows e.g. for easier insertion into bulk material. The radius at the end region may be e.g. 3 mm, 5 mm or 10 mm. This also allows to avoid damage to the bag wall and the filling spout.

The filter device 10 of the suction device 6 is retained by the bottom cover 25 and the tube device 9.

The drive shaft 18 is rotatably supported by means of a bearing 21 in the interior of the poker compactor 2 at the axial end region 19 in the vicinity of the front face 16. A bearing 22 to support the drive shaft 18 is employed at the other end at the bottom face 17 in the end region 20.

This filter device 10 consists of multiple filter layers 11 wherein one of the filter layers or a separate support layer may serve to support the filter device 10.

A clearance or vacuum chamber 26 is formed between the filter device 10 and the outer surface of the tube device 9 through which air is aspirated from the filter device 10 across the entire surface. The aspirated air is discharged through the vacuum connections 30, 31 and 32. The interior of the vacuum tank 2 shows the imbalance weight 38. It should be noted that the illustration according to FIG. 7 is section B-B from FIG. 4 so that the cutting planes of the central axis of symmetry above the axis of symmetry and beneath the axis of symmetry are angled relative to one another.

Figure 8:
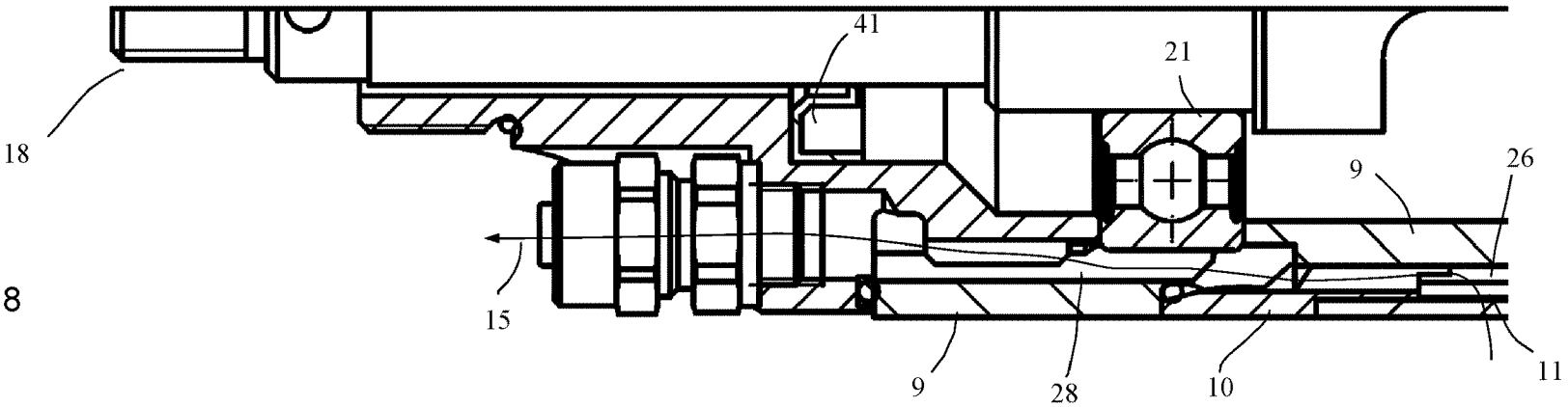
FIG. 8 the enlarged detail "D" from FIG. 7.

FIG. 8 shows the enlarged detail "D" from FIG. 7 to better illustrate the flow curve of the sucked off air and each of the components.

A seal 41 is provided for sealing and protection of the bearing 21 from dust penetrating through the passage 24 of the drive shaft 18.

The aspirated air is conveyed from the vacuum chamber 26 to the pertaining vacuum connection along the flow arrow 15. The aspirated air first flows through the air duct 28. In the region of the thread 39 of the connecting piece 23 the air duct 28 is limited by the groove 40 in the connecting piece 23 (see FIG. 5) and by the tube device 9.

Figure 13:
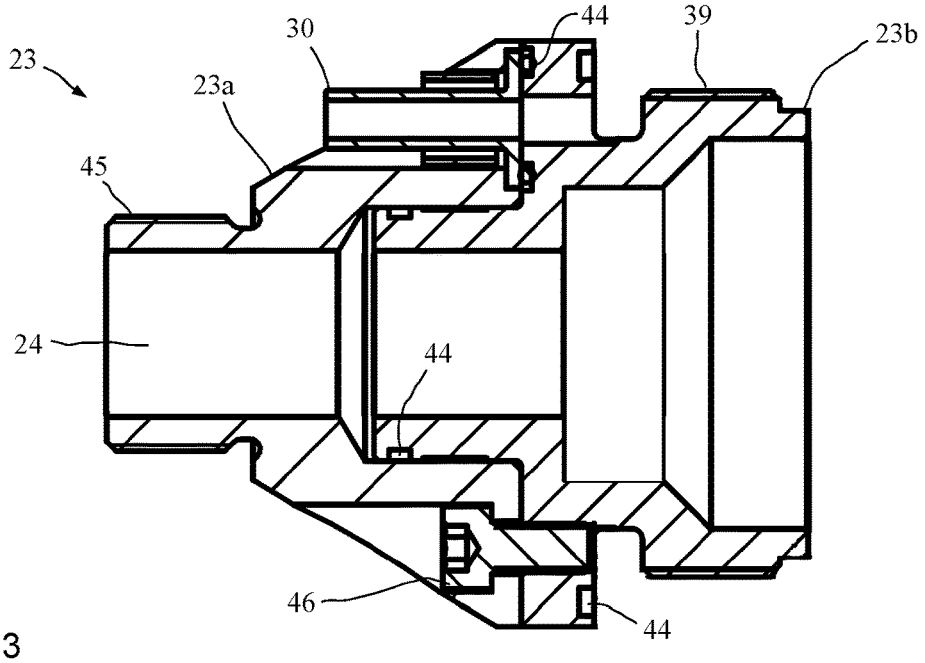
FIG. 13 a two-part connecting piece for the poker compactor according to FIG. 3.

FIG. 13 shows a variant of the connecting piece 23 of the poker compactor 2 from FIG. 7 wherein the connecting piece 23 is configured multipart, presently two-piece, and substantially consists of the first connecting part 23*a* and the second connecting part 23*b*. For servicing the first connecting part 23*a* remains at the packaging machine while the second connecting part 23*b* is removed together with the poker compactor 2. Thus the vacuum hoses may remain at the vacuum connections 30 etc. and do not require relatively complex demounting and later remounting, in particular because a specific hose routing needs to be observed. These vacuum connections 30 to 32 are preferably again separate components which when connecting the connecting parts 23*a* and 23*b* are clamped to an undercut of the first connecting part 23*a*. The two connecting parts 23*a* and 23*b* are connected to one another by suitable connecting devices 46 such as screws. Suitable seals 44 are preferably provided between the connecting parts. A custom-made seal 44 is also provided between the vacuum connection 30 and the first connecting part 23*a*.

The connecting piece 23 is provided with a thread 39 which screws to a counter-thread of the tube device 9. The sealing of the connecting piece 23 generally to the tube device 9 is preferably also done by suitable seals 44.

An external thread 45 is configured at the (upper) end of the first connecting part 23*a* to connect a sleeve of a drive shaft in that spot.

Figure 9:
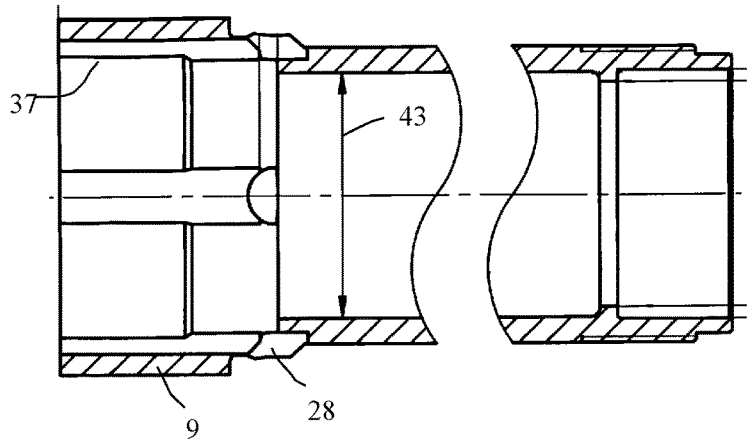
FIG. 9 a simplistic cross-section of the tube device of the poker compactor according to FIG. 3.

FIG. 9 shows a schematic cross-section of the tube device 9 with the internal thread 37 in the tube device 9 recognizable. The external thread 39 of the connecting piece 23 screws into the internal thread 37. Furthermore the air duct 28 is recognizable through which the aspirated air is forwarded from the clearance or vacuum chamber 26.

In the interior of the tube device 9 a free diameter 43 is formed in which the imbalance device 8 can rotate for generating vibrations.

Figure 10:
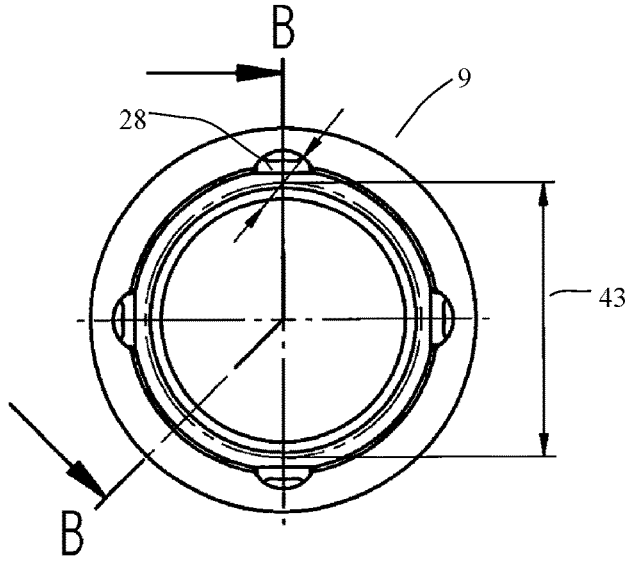
FIG. 10 a front view of the tube device according to FIG. 9.

FIG. 10 shows a front view of the tube device 9 in which the air ducts 28 are also visible. For illustration the section B-B shown in FIG. 7 is indicated once again.

Figure 11:
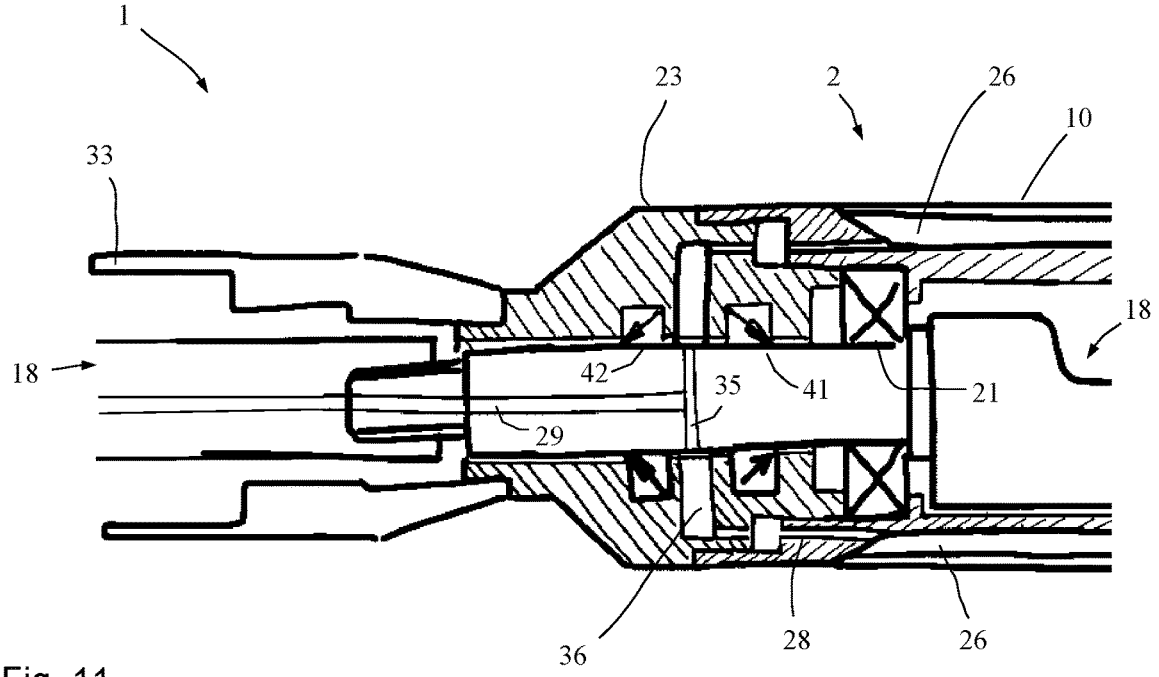
FIG. 11 another compacting device.

FIG. 11 shows another embodiment of the compacting device 1, with a connecting hose 33 attached to the connecting piece 23 of the front face 16. The vacuum feed takes place through a vacuum duct 29 in the interior of the drive shaft 18. The drive shaft 18 is configured multipart. The vacuum duct 29 opens into at least one transverse duct 35 that extends radially outwardly from the vacuum duct 29. The transverse duct 35 may be generated for example by a transverse bore in the drive shaft 18. In the region of the transverse duct 35 a connecting duct 36 is provided circling around the drive shaft 18 connecting the vacuum duct 29 with the air duct 28 so that vacuum applied to the vacuum duct 29 continues through the transverse duct 35 and the connecting duct 36 and the air duct 28 into the vacuum chamber 26.

The connecting duct 36 is sealed on both axial sides by means of a seal 41 or 42 to protect the bearing 21 from dust.

This construction allows ease of feeding vacuum to the suction device 6. The bearing of the imbalance device 8 is reliably protected from the influence of dust. The filter device can be efficiently freed from caked particles.

Figure 12:
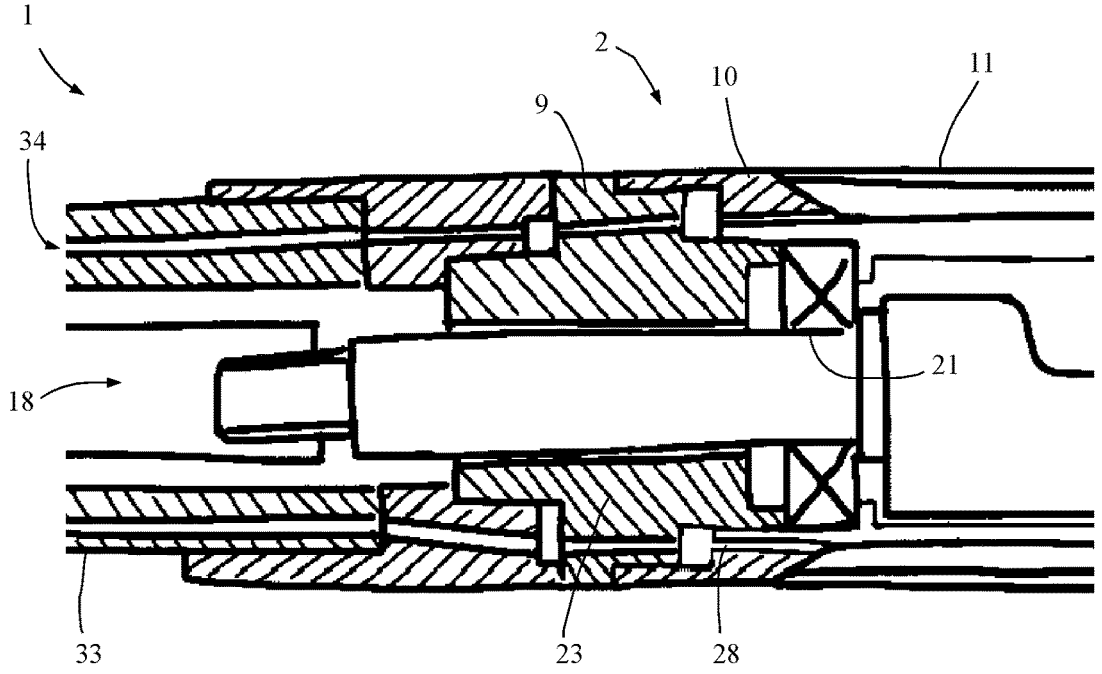
FIG. 12 another compacting device for the packaging system according to FIG. 1.

FIG. 12 shows an alternative configuration where the vacuum feed does not take place centrally through the drive shaft but external thereof. The compacting device 1 may basically show the architecture of the compacting device of FIG. 7 with a connecting hose 33 mounted to the connecting piece 23 at the front face 16 to ensure vacuum supply.

The connecting hose 33 comprises vacuum lines 34 serving for vacuum supply disposed or configured in the wall of the connecting hose 33. The vacuum lines 34 may be attached to the inner wall of the connecting hose 33 or may be positioned in the interior of the connecting hose 33 wherein they are preferably protected from rubbing contact with the rotating drive shaft 18.

The vacuum lines 34 are directly connected with the air ducts 28 so that the vacuum chamber 26 of the suction device 6 can be adequately supplied with vacuum. The air ducts 28 extend radially externally of the bearings 21 as they do in the preceding exemplary embodiment so that the region of the bearings 21 is reliably protected from dust action.

The air ducts 28 may extend through the tube device at least in sections.

On the whole the invention provides an advantageous compacting device 1 and an advantageous packaging system 100 equipped therewith which allow efficient filling of open containers with bulk material and efficient compacting of the bulk material in the containers. The vibration generated inside the poker compactor imposes a vibration on the filter device 10 so as to largely prevent the building up of filter caking even with fine bulk material. This allows to clearly reduce the quantity of air blasts required on the filter device from the interior so as to increase efficiency.

LIST OF REFERENCE NUMERALS

1 compacting device
2 poker compactor
3 bulk material
4 container
5 outer wall
6 suction device
7 suction wall
8 imbalance device
9 tube device
10 filter device
11 filter layer
12 length of 4
13 length of 2
14 diameter of 2
15 flow arrow
16 front face
17 bottom face
18 drive shaft
19 end region at 16
20 end region at 17
21 bearing at 19
22 bearing at 20
23 connecting piece
23*a* first connecting part
23*b* second connecting part
24 passage

25 bottom cover
26 vacuum chamber
27 longitudinal direction
28 air duct
29 vacuum duct
30 vacuum connection
32 vacuum connection
33 vacuum connection
33 connecting hose
34 vacuum line
35 transverse duct
36 connecting duct
37 thread in 9
38 imbalance weight
39 thread of 23
40 groove
41 seal
42 seal
43 inner diameter of 9
44 seal
45 thread
46 screw
47 pressure sensor
48 vibration exciter
49 drive motor
50 packaging machine
51 filling spout
52 silo
53 carrier
54 filling element, fill turbine
55 fill level sensor
56 scales
57 control device
58 dispensing silo
59 bottom vibrator
100 packaging system
101 container feeder
102 transfer device
103 discharge device
104 processing device
105 closing device

The invention claimed is:

1. A compacting device comprising:

a poker compactor for compacting bulk material in an open container, the poker compactor comprising;

an outer wall and configured to be inserted into an open container to cause the outer wall of the poker compactor to contact the bulk material and to degas and compact the bulk material in the open container, wherein the outer wall of the poker compactor is at least partially formed by a gas-permeable outer suction wall of a suction device;

a vibration exciter to support degassing the bulk material by way of vibration of the poker compactor generated by the vibration exciter, wherein the vibration exciter is radially surrounded by a tube device, and the suction wall surrounds the tube device at least in sections;

a multipart and separable connecting piece at a front face of said poker compactor, said connecting piece including a passage for a drive shaft of said poker compactor; and at least one connecting hose attached to said connecting piece, wherein at least one vacuum line is at least partially within said at least one connecting hose.

2. The compacting device according to claim 1, wherein the vibration exciter comprises at least one rotatably accommodated imbalance device.

3. The compacting device according to claim 1, wherein the suction wall at least partially consists of an air-permeable filter device.

4. The compacting device according to claim 3, wherein the filter device is exchangeably supported by the tube device.

5. The compacting device according to claim 1, wherein the poker compactor includes a diameter and a length, wherein a ratio of the length to the diameter of the poker compactor is greater than 3.

6. The compacting device according to claim 1, wherein at least one bearing for supporting the drive shaft is accommodated at least at one axial end region of the tube device.

7. The compacting device according to claim 1, wherein the suction device comprises a vacuum chamber that is substantially formed by a radial clearance between the tube device and the filter device.

8. The compacting device according to claim 7, wherein the vacuum chamber is connected with at least one vacuum connection through at least one air duct.

9. The compacting device according to claim 8, wherein the air duct extends at least partially radially outside the bearings.

10. The compacting device according to claim 8, wherein the air duct extends at least partially through the tube device.

11. The compacting device according to claim 1, wherein at least one vacuum duct extending in a longitudinal direction of the drive shaft is within the interior of the drive shaft to supply the suction device with vacuum.

12. The compacting device according to claim 1, wherein the vacuum duct is in flow connection with a connecting duct of the poker compactor through at least one transverse duct.

13. The compacting device according to claim 12, wherein the connecting duct is sealed relative to the drive shaft by way of a seal at least on one axial side.

14. The compacting device according to claim 1, wherein the suction device is indirectly or directly axially downstream of one of the tube device or the vibration exciter.

15. The compacting device according to claim 1, further comprising a bottom cover attached to a bottom face of said poker compactor.

16. A packaging system comprising:

at least one open container intended to be filled with bulk material;

at least one packaging machine having at least one filling spout for filling open containers with bulk material, said at least one packaging machine comprising:

a compacting device with a poker compactor, the poker compactor comprising an outer wall and configured to be inserted into an open container to cause the outer wall to contact the bulk material and to degas and compact the bulk material in the open container, wherein the outer wall of the poker compactor is at least partially formed by a gas-permeable, outer suction wall of a suction device;

a vibration exciter to support degassing the bulk material by way of a vibrating motion of the poker compactor generated by the vibration exciter, wherein the vibration exciter is radially surrounded by a tube device and the suction wall surrounds the tube device at least in sections;

a multipart and separable connecting piece at a front face of said poker compactor, said connecting piece including a passage for a drive shaft said poker compactor; and at least one connecting hose attached to said connecting piece, wherein at least one vacuum line is at least partially within said at least one connecting hose.

17. The packaging system according to claim 16, wherein at least one of a pressure sensor and a fill level sensor is assigned to the filling spout.

18. The packaging system according to claim 16, wherein the poker compactor is height-adjustable and can be inserted into the container through the filling spout.

19. A method for filling an open container with at least one bulk material in a filling process, the method comprising:

filling a quantity of bulk material into the open container;

inserting a poker compactor of a compacting device into the open container to degas and compact the bulk material in the open container, wherein said poker compactor includes a multipart and separable connecting piece at a front face of said poker compactor, said connecting piece including a passage for a drive shaft of said poker compactor;

attaching at least one connecting hose to said connecting piece, and inserting at least one vacuum line at least partially within said at least one connecting hose; and vibrating the open container using a vibration exciter of the poker compactor that is radially surrounded by a tube device to aspirate gas out of the bulk material at the poker compactor by means of a suction device through a gas-permeable, outer suction wall which forms part of the outer wall surrounding the tube device at least in sections to support degassing the bulk material.

20. The method according to claim 19, wherein the poker compactor is inserted into the open container as the filling process begins.

21. The method according to claim 19, wherein the vibration exciter at the poker compactor is caused to vibrate and gas is sucked out of the bulk material at the poker compactor simultaneously at least in sections.

22. The method according to claim 19, wherein only the vibration exciter at the poker compactor is caused to vibrate at least in sections and gas is sucked out of the bulk material at the poker compactor.

23. The method according to claim 19, wherein at certain points in time a gas impulse is applied to a sucking-off device.

24. The method according to claim 19, wherein a position of the poker compactor relative to the container is changed multiple times for efficient degassing.

25. The method according to claim 23, wherein gas is not sucked off by means of the suction device until a fill level of the bulk material in the container substantially entirely covers the suction wall.

* * * * *